United States Patent [19]

Mapes et al.

[11] 4,295,835

[45] Oct. 20, 1981

[54] HIGH SPEED OUTBOARD DRIVE UNIT

[75] Inventors: Charles W. Mapes; Richard H. Snyder, both of Oshkosh, Wis.

[73] Assignee: Brunswick Corporation, Skokie, Ill.

[21] Appl. No.: 83,176

[22] Filed: Oct. 9, 1979

[51] Int. Cl.[3] ..... B63H 1/14; B63H 5/06; B63H 21/32

[52] U.S. Cl. ..... 440/78; 440/66; 440/900; 440/89; 416/93 A

[58] Field of Search ..... 440/900, 89, 66, 73, 440/76, 78, 71, 77, 79; 416/146 R, 234, 238

[56] References Cited

U.S. PATENT DOCUMENTS

| | | | |
|---|---|---|---|
| 1,649,657 | 11/1927 | Blake | 440/73 |
| 2,089,366 | 10/1937 | Hansen | 440/76 |
| 3,554,665 | 1/1971 | Lorenz | 440/89 |
| 3,727,574 | 4/1973 | Bagge | 440/66 |
| 3,939,792 | 2/1976 | Wasenius | 440/900 |
| 3,939,795 | 2/1976 | Rocka | 440/78 |
| 4,080,099 | 4/1978 | Snyder | 416/146 R |
| 4,096,819 | 6/1978 | Evinrude | 440/78 |

*Primary Examiner*—Trygve M. Blix
*Assistant Examiner*—D. W. Keen
*Attorney, Agent, or Firm*—O. Thomas Sessions

[57] ABSTRACT

An engine driven outboard drive unit for propelling a watercraft has a vertical drive shaft driving a horizontal propeller shaft on which a propeller is mounted. The drive unit has a gearcase torpedo which houses both the propeller shaft and an annular exhaust gas passage. The exhaust passage discharges aft through the plane of the propeller. A small annular projection is formed around the aft end of the torpedo to improve high speed performance.

8 Claims, 6 Drawing Figures

HIGH SPEED OUTBOARD DRIVE UNIT

BACKGROUND OF THE INVENTION

The invention relates to outboard drive units and more specifically to drive units which employ underwater exhaust through the lower gearcase.

It is common practice for outboard motors and marine stern drive units to use exhaust systems routing the exhaust down the drive shaft housing, through the lower gearcase, and out an annular passage in the propeller hub. These units are commonly called through-the-hub-exhaust or jet-prop systems. As outboard motor power has risen to 200 horsepower and beyond, non jet-prop propellers such as that described in U.S. Pat. No. 4,080,099, issued to Richard H. Snyder have proven to be the fastest propellers for use on jet-prop units.

At high speed, 70 to 90 miles per hour, certain conditions apparently can cause the exhaust to suddenly ventilate forward along the low pressure side of the gearcase torpedo when a non jet-prop is used. A reaction then occurs which feeds this exhaust into the low pressure side of the propeller blades. A loss of speed, a loss in the bow lifting capacity of the propeller, and a tendency for the boat to go into a slight left-hand turn results, presuming a right-hand propeller is used. This occurrence has been termed a "blowout".

SUMMARY OF THE INVENTION

The inventors have discovered that providing an annular projection substantially encircling the aft end of the gearcase torpedo will substantially elevate the speed at which "blowout" will occur on an outboard drive unit using a jet-prop system and a non jet-prop propeller. A very small projection can be used, on the order of 0.003 to 0.020 inches (0.08 to 0.5 mm) and the projection can take several forms, such as rectangular or triangular.

DETAILED DESCRIPTION OF THE PREFERRED EMBODIMENT

Figure 1:
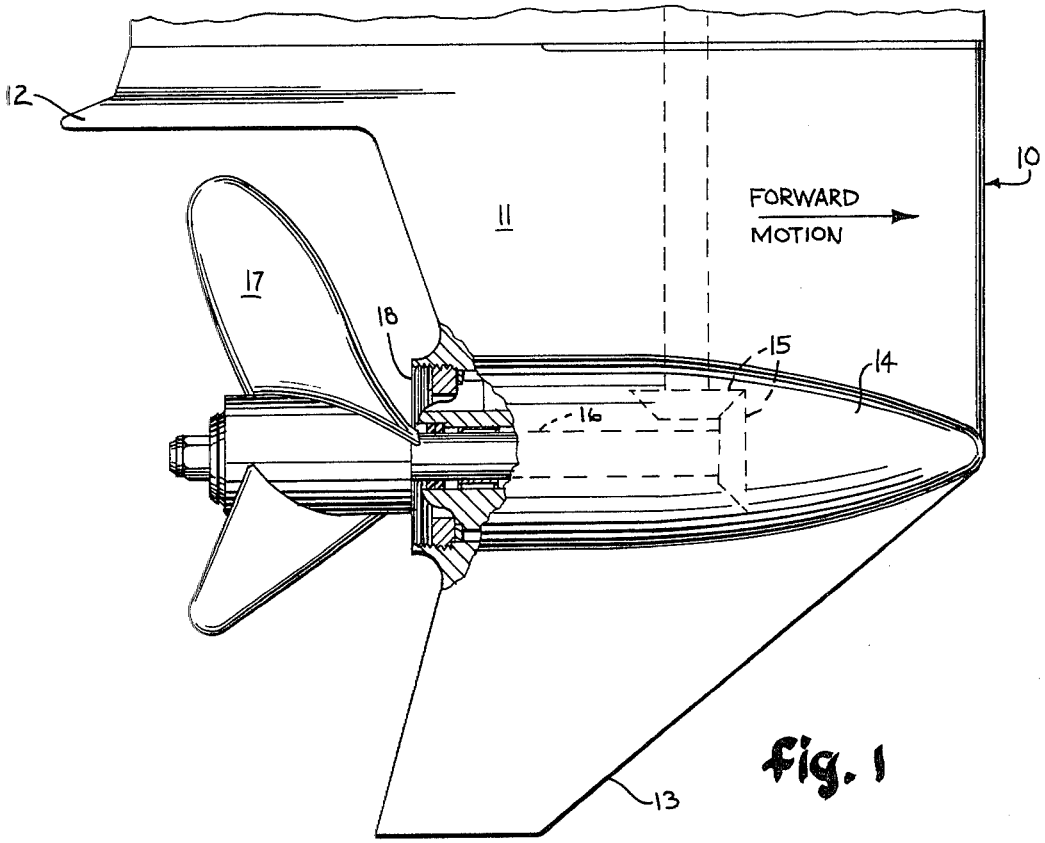
FIG. 1 shows the lower end of an outboard drive unit.

FIG. 1 is a side view of a lower outboard drive unit 10 suitable for use on an outboard motor or a marine stern drive. Such units are well known to those skilled in the art and include a housing 11, an integral anti-ventilation plate 12, a skeg 13, and a torpedo 14. The torpedo 14 houses drive gears 15 for propeller shaft 16, which drives propeller 17. The housing 11 includes an internal exhaust gas passageway which discharges through an annular opening 18 at the aft end of the torpedo 14. The torpedo 14 is cylindrically shaped with an essentially constant diameter aft section. An annular projection having a height, h, of 0.003 to 0.020 inches (0.08 to 0.5 mm) is formed on the aft end of the torpedo 14 and serves to substantially increase the speed at which "blowout" occurs.

Figure 2:
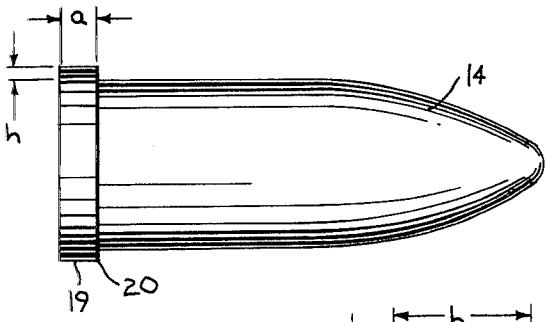
FIGS. 2–6 illustrate the invention as embodied in five different forms.
Figure 3:
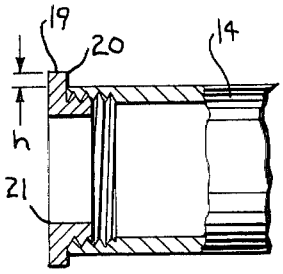

A first embodiment of the invention is illustrated in exaggerated form in FIG. 2. An annular projection 19 is formed on the aft end of the torpedo 14. The projection 19 preferably has a sharp corner 20 on its leading edge, a length, a, up to $\frac{1}{2}$ inch ($1\frac{1}{4}$ cm) and a height, h, in the range described above. The projection 19 may be formed by an integral part of the cast housing 11, by a tape or metal band encircling the torpedo 14, or by a paint or weld build-up. Alternately the projection 19 may be formed as shown in FIG. 3 by a shouldered ring 21. The ring 21 may be screwed into or to the torpedo 14 as shown or pressed into place.

Figure 4:
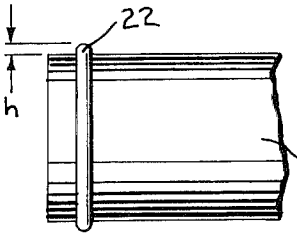

The annular projection at the end of the torpedo 14 may take other shapes within the scope of the invention. FIG. 4 illustrates an embodiment of the invention where an annular projection is formed by a wire 22 wrapped into a shallow groove at the rear of the torpedo 14. Wires having diameters from 0.005 to 0.032 inches (0.13 to 0.8 mm) having proven effective to increase the speed at which "blowout" occurs when wrapped in a groove to produce a projection height h of 0.003 to 0.020 inches (0.08 to 0.5 mm).

Figure 5:
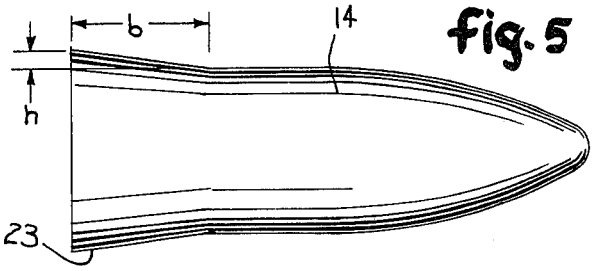
Figure 6:
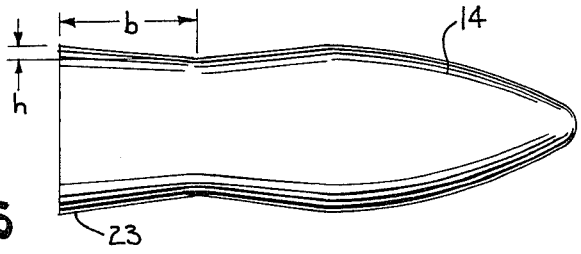

FIGS. 5 and 6 show embodiments wherein the annular projection of the invention is shaped as a slight conical flare at the aft end of torpedo 14. The flare forms an annular projection having a triangular cross-section. The outer surface of the flare can be either linear or slightly concave. In both embodiments flares 23 having a height h of 0.003 to 0.020 inches (0.08 to 0.5 mm) and a length b up to 4 inches (10 cm) have increased the speed at which "blowout" occurs. The flare 23 of FIG. 5 is formed aft of a constant diameter cylindrical section while the flare 23 shown in FIG. 6 follows a section of the torpedo 14 having a slightly decreasing diameter.

Though the mechanism by which the invention increases the speed at which "blowout" occurs is not fully understood, apparently exhaust gas is blocked from ventilating forward along the gearcase torpedo 14 by the build up of a more positive pressure barrier at the aft end of the torpedo 14. The present invention achieves this pressure build up with a minimum of increased drag.

We claim:

1. An engine driven outboard drive unit for attachment to a watercraft comprising:

(A) a generally vertical housing;

(B) a generally vertical drive shaft journalled for rotation within said housing and driven by said engine;

(C) a generally horizontal propeller shaft driven by the lower end of said drive shaft;

(D) a propeller mounted on the aft end of said propeller shaft;

(E) a streamlined torpedo of generally cylindrical shape fixed to the lower end of said housing with said propeller shaft journalled for rotation within said torpedo forward of said propeller, said torpedo comprising an engine exhaust passage for discharging exhaust gases through the plane of said propeller; and (F) an annular projection substantially encircling the aft end of said torpedo to prevent blowout at high speeds.

2. The drive unit defined in claim 1 wherein said annular projection is rectangular in cross-section.

3. The drive unit defined in claim 2 wherein said annular projection comprises a wire wrapped around said torpedo.

4. The drive unit defined in claim 1 wherein said annular projection is triangular in cross-section.

5. The drive unit defined in claim 4 wherein said annular projection has a height in the range of 0.003 inches to 0.020 inches (0.08 to 0.5 mm).

6. The drive unit defined in claim 5 wherein said annular projection is located within 4 inches of the aft end of said torpedo.

7. The drive unit defined in claim 1 wherein said annular projection comprises a ring attached to the aft end of said torpedo.

8. The drive unit defined in claim 2, 7, or 3 wherein said annular projection is located within 0.5 inches of the aft end of said torpedo.

* * * * *